US010415402B2

(12) United States Patent
Murdock et al.

(10) Patent No.: US 10,415,402 B2
(45) Date of Patent: Sep. 17, 2019

(54) BLADE WEAR PADS AND MANUFACTURE METHODS

(71) Applicant: United Technologies Corporation, Hartford, CT (US)

(72) Inventors: James R. Murdock, Tolland, CT (US); Kwan Hui, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 953 days.

(21) Appl. No.: 14/774,000

(22) PCT Filed: Dec. 20, 2013

(86) PCT No.: PCT/US2013/076772

§ 371 (c)(1),
(2) Date: Sep. 9, 2015

(87) PCT Pub. No.: WO2014/143318

PCT Pub. Date: Sep. 18, 2014

(65) Prior Publication Data

US 2016/0024947 A1 Jan. 28, 2016

Related U.S. Application Data

(60) Provisional application No. 61/780,293, filed on Mar. 13, 2013.

(51) Int. Cl.
*F01D 5/30* (2006.01)
*F01D 5/14* (2006.01)

(52) U.S. Cl.
CPC ..... *F01D 5/3092* (2013.01); *F01D 5/147* (2013.01); *F01D 5/3007* (2013.01);
(Continued)

(58) Field of Classification Search
CPC ..... F01D 5/147; F01D 5/3007; F01D 5/3092; F01D 5/323; F05D 2220/32;
(Continued)

(56) References Cited

U.S. PATENT DOCUMENTS 2,667,327 A * 1/1954 Hardigg ..... F01D 5/323 29/513
5,160,243 A * 11/1992 Herzner ..... F01D 5/28 416/220 R (Continued)

FOREIGN PATENT DOCUMENTS

EP 2423442 A2 2/2012
JP 08326503 A 12/1996

OTHER PUBLICATIONS

International Search Report and Written Opinion for PCT/US2013/076772, dated Apr. 28, 2014.

(Continued)

*Primary Examiner* — Mark A Laurenzi
*Assistant Examiner* — Paul Thiede
(74) *Attorney, Agent, or Firm* — Bachman & LaPointe, P.C.

(57) ABSTRACT

A blade assembly comprises a blade (120) and one or more wear pads (170, 172). The blade has an airfoil (122) having a leading edge (126), a trailing edge (128), a pressure side (130), a suction side (132), and extending from an inboard end to a tip (125). The blade further includes an attachment root (124). The one or more wear pads are along the attachment root. The one or more wear pads have a plurality of slits (228, 230 242).

20 Claims, 5 Drawing Sheets

(52) U.S. Cl.
CPC ..... *F05D 2220/32* (2013.01); *F05D 2220/36* (2013.01); *F05D 2230/60* (2013.01); *F05D 2240/30* (2013.01); *F05D 2300/173* (2013.01); *F05D 2300/174* (2013.01); *F05D 2300/434* (2013.01); *F05D 2300/6012* (2013.01)

(58) Field of Classification Search
CPC ..... F05D 2220/36; F05D 2230/60; F05D 2240/30; F05D 2300/173; F05D 2300/174; F05D 2300/434; F05D 2300/6012
USPC ..... 416/219 R; 29/513
See application file for complete search history.

(56) References Cited

U.S. PATENT DOCUMENTS 5,240,375 A * 8/1993 Wayte ..... F01D 5/28 416/219 R
5,791,879 A * 8/1998 Fitzgerald ..... F01D 5/147 416/229 A
6,431,835 B1 8/2002 Kolodziej et al.
7,938,626 B2 * 5/2011 Forgue ..... F04D 29/322 416/220 R
2004/0151590 A1 8/2004 Forrester et al.
2007/0048142 A1 3/2007 Dambrine et al.
2009/0060745 A1 3/2009 Douguet et al.
2009/0081046 A1 3/2009 Mace et al.
2010/0284816 A1 * 11/2010 Propheter-Hinckley ..... F01D 5/3007 416/241 B
2011/0250626 A1 * 10/2011 Williams ..... A01N 63/02 435/18
2012/0251328 A1 10/2012 Connor et al.

OTHER PUBLICATIONS

Typical Properties VESPEL ASB Line, Jun. 2003, E.I. du Pont de Nemours and Company, Wilmington, Delaware.
European Office action dated Jan. 31, 2018 for European Patent Application No. 13878065.5.
European Search Report dated Dec. 20, 2016 for European Patent Application No. 13878065.5.

* cited by examiner

BLADE WEAR PADS AND MANUFACTURE METHODS

CROSS-REFERENCE TO RELATED APPLICATION

Benefit is claimed of U.S. Patent Application Ser. No. 61/780,293, filed Mar. 13, 2013, and entitled "Blade Wear Pads and Manufacture Methods", the disclosure of which is incorporated by reference herein in its entirety as if set forth at length.

BACKGROUND

The disclosure relates to turbofan engines. More particularly, the disclosure relates to fan blade mounting.

An exemplary turbofan engine includes one or more blade stages driven directly or indirectly by a low pressure turbine (LPT) of the engine. In an exemplary blade stage, the circumferential array of blades are mounted to a disk or other hub structure. Exemplary blades include a dovetail attachment root which is received in a dovetail slot in the hub. The exemplary slot and root have a base and have a first side and a second side extending radially outward from the base and generally converging toward the outer diameter (OD) perimeter of the hub. There may a rounded interface between the slot and the hub (OD) surface. The slots may be longitudinal or off-longitudinal at an acute angle and may be straight or have a curvature.

Exemplary blades comprise at least a substrate formed of a titanium alloy, an aluminum alloy, a composite or combination. Exemplary hubs are of titanium alloy or aluminum alloy. Portions of the blades may bear coatings for one or more purposes (e.g., corrosion protection, erosion protection, foreign object damage, or even abrasive coatings at blade tips). To protect the interface between the root and the slot, it is known to use wear pads along the sides of the root. The exemplary wear pads are formed of sheet stock of non-metallic material (e.g., polymeric fabric or other fabric material). Exemplary fabric material is VESPEL ASB polyimide, E. I. du Pont de Nemours and Company, Wilmington, Del.

SUMMARY

One aspect of the disclosure involves a blade assembly comprising a blade and one or more wear pads. The blade has an airfoil having a leading edge, a trailing edge, a pressure side, a suction side, and extending from an inboard end to a tip. The blade further includes an attachment root. The one or more wear pads are along the attachment root. The one or more wear pads have a plurality of cuts.

In additional or alternative embodiments of any of the foregoing embodiments, the one or more wear pads may comprise a first wear pad along a first side of the attachment root and a second wear pad along a second side of the attachment root opposite the first side.

In additional or alternative embodiments of any of the foregoing embodiments, the blade comprises an aluminum alloy or titanium alloy substrate.

In additional or alternative embodiments of any of the foregoing embodiments, the wear pad comprises a fabric.

In additional or alternative embodiments of any of the foregoing embodiments, the wear pad comprises polyimide fiber.

In additional or alternative embodiments of any of the foregoing embodiments, the wear pads are adhered to the attachment root.

In additional or alternative embodiments of any of the foregoing embodiments, the plurality of cuts include a plurality of radially outwardly directed cuts opening to an outboard edge of the associated pad.

In additional or alternative embodiments of any of the foregoing embodiments: the cuts include a plurality of cuts opening along an end portion of the pad along at least one of a leading end or a trailing end of the attachment root.

In additional or alternative embodiments of any of the foregoing embodiments, the attachment root is a dovetail root.

Another aspect of the disclosure involves a gas turbine engine comprising a fan hub having a plurality of slots and a plurality of the blade assemblies of with the attachment roots accommodated in associated said slots.

In additional or alternative embodiments of any of the foregoing embodiments, a method for manufacturing the blade comprises: cutting the pads from pad material, including cutting the cuts; and applying the pads to the attachment root, the applying at least one of contracting the cuts and expanding the cuts.

In additional or alternative embodiments of any of the foregoing embodiments, the applying contracts cuts along one side of the root and expands the cuts along the other side.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
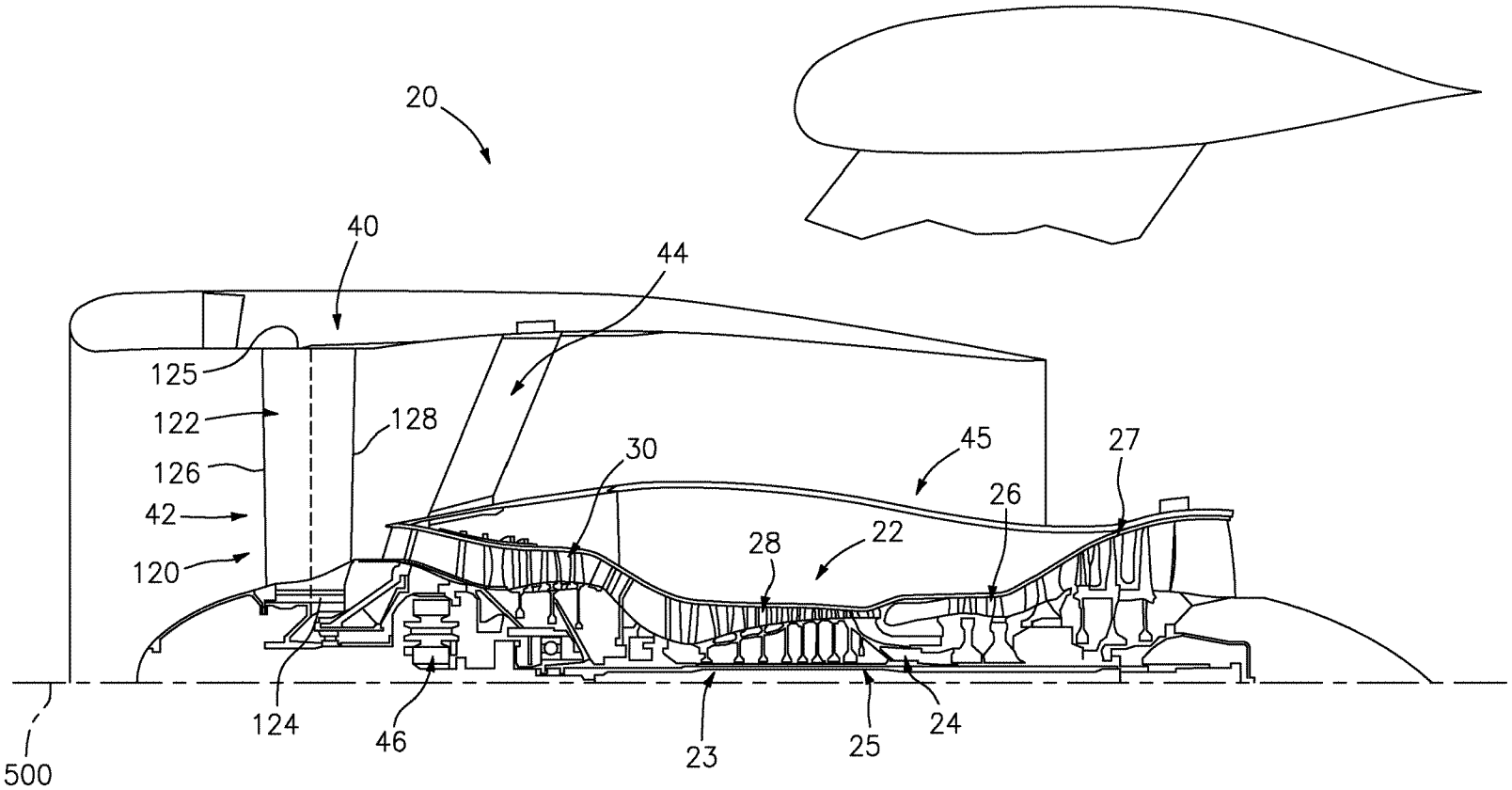
FIG. 1 is a schematic sectional view of a gas turbine engine.

FIG. 1 shows a turbofan engine 20 having an engine case 22 containing a rotor shaft assembly 23. An exemplary engine is a high-bypass turbofan. In such an engine, the normal cruise condition ratio of air mass flowing outside the core (e.g., the compressor sections and combustor) to air mass passing through the core (the bypass ratio) is typically in excess of about 4.0 and, more narrowly, typically between about 4.0 and about 16.0. Via high 24 and low 25 shaft portions of the shaft assembly 23, a high pressure turbine (HPT) section 26 and a low pressure turbine (LPT) section 27 respectively drive a high pressure compressor (HPC) section 28 and a low pressure compressor (LPC) section 30. The engine extends along a longitudinal axis (centerline) 500 from a fore end to an aft end. Adjacent the fore end, a shroud (fan case) 40 encircles a fan 42 and is supported by vanes 44. An aerodynamic nacelle around the fan case is shown and an aerodynamic nacelle 45 around the engine case is shown.

Figure 2:
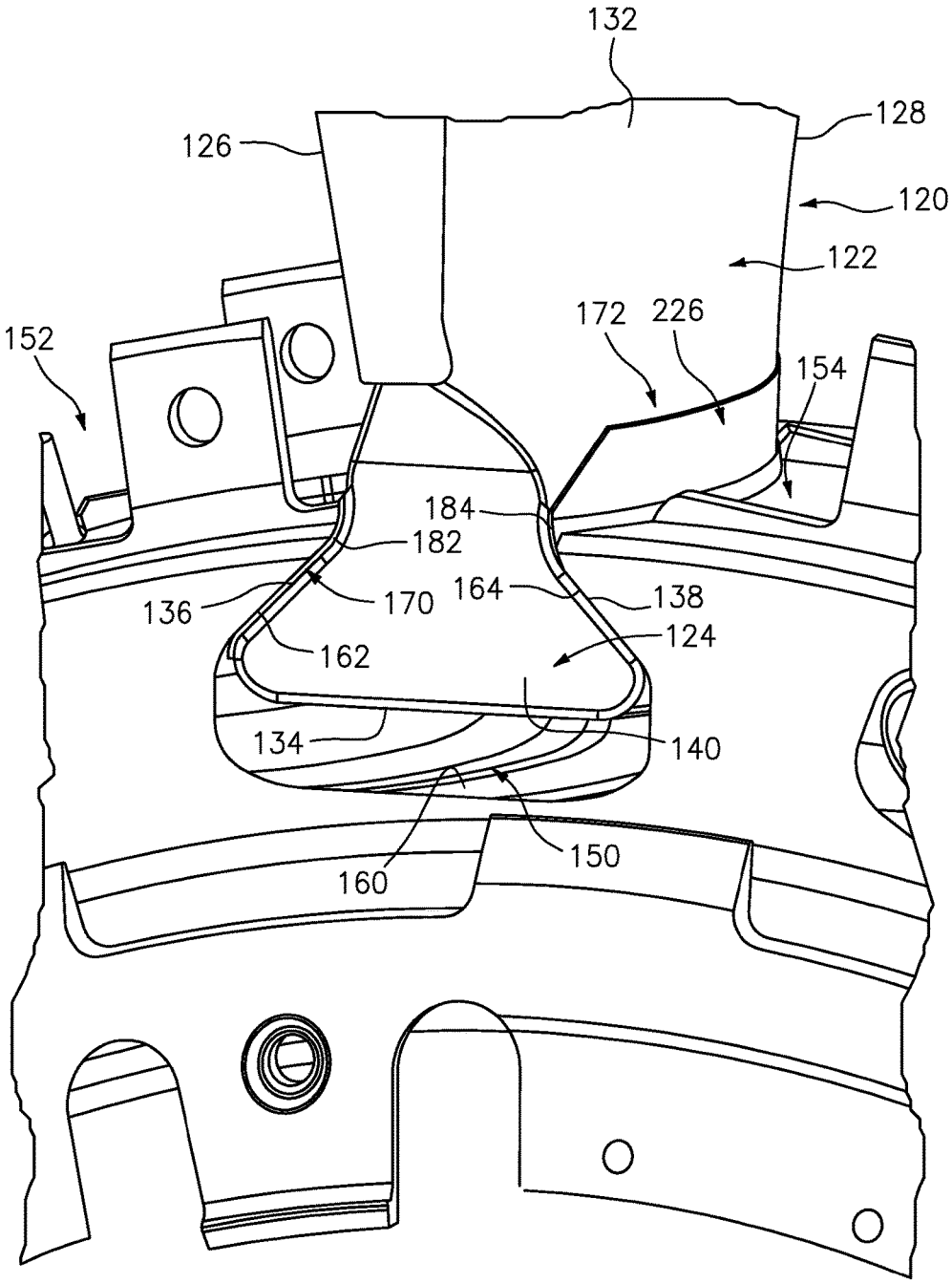
FIG. 2 is a forward perspective cutaway view of a hub slot with a blade attachment root
Figure 4:
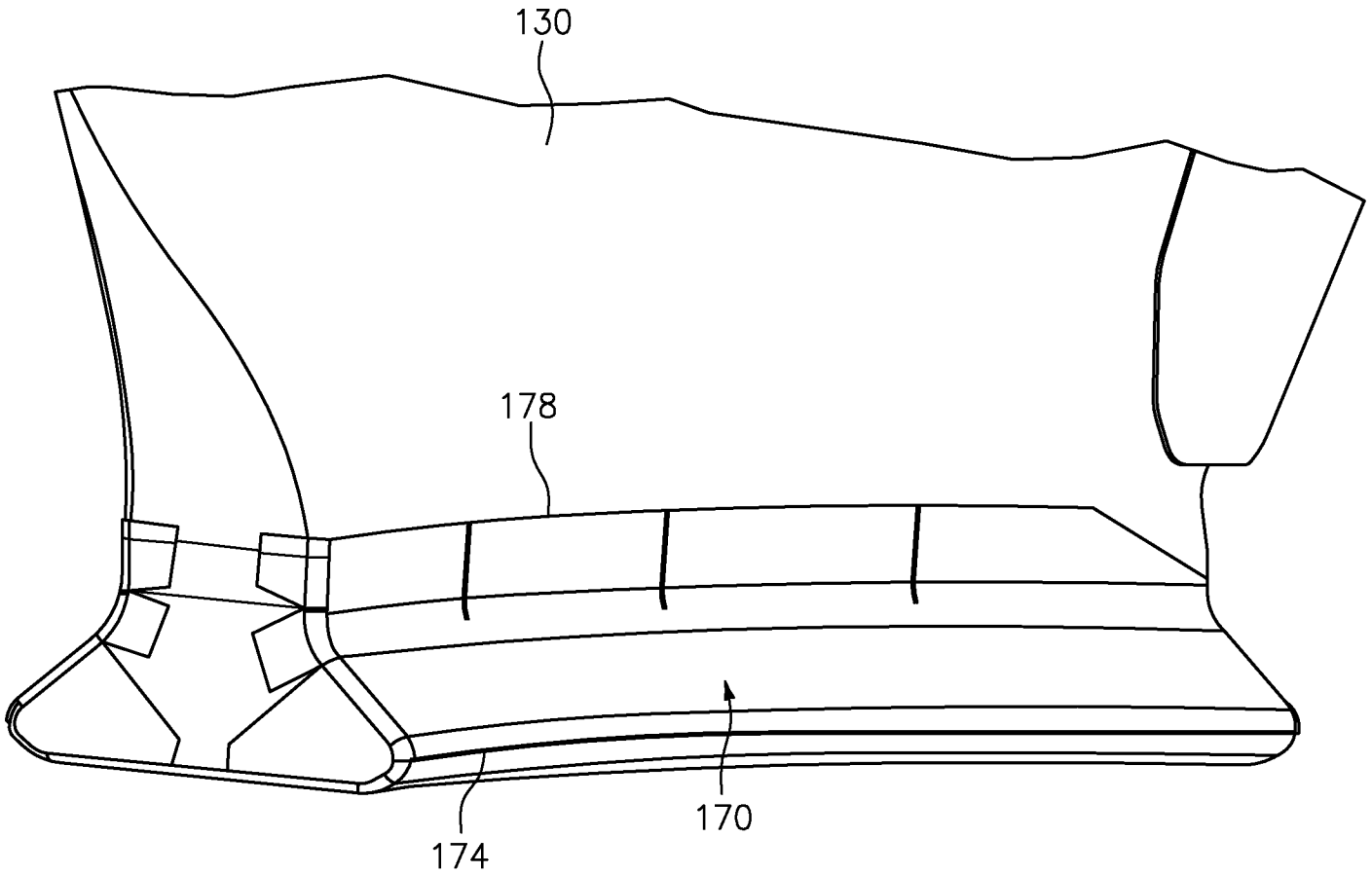
FIG. 4 is an isolated cutaway view of the blade of FIG. 2 viewed generally from the trailing edge and the concave side.

FIG. 2 shows a fan blade 120 comprising an airfoil 122 and an attachment root 124. The airfoil extends from an inboard end at the root to an outboard end (not shown) which may be a shrouded tip or a shroudless tip 125 (FIG. 1). The airfoil extends from a leading edge 126 to a trailing edge 128 and has a pressure side 130 (FIG. 4) and a suction side 132.

Figure 3:
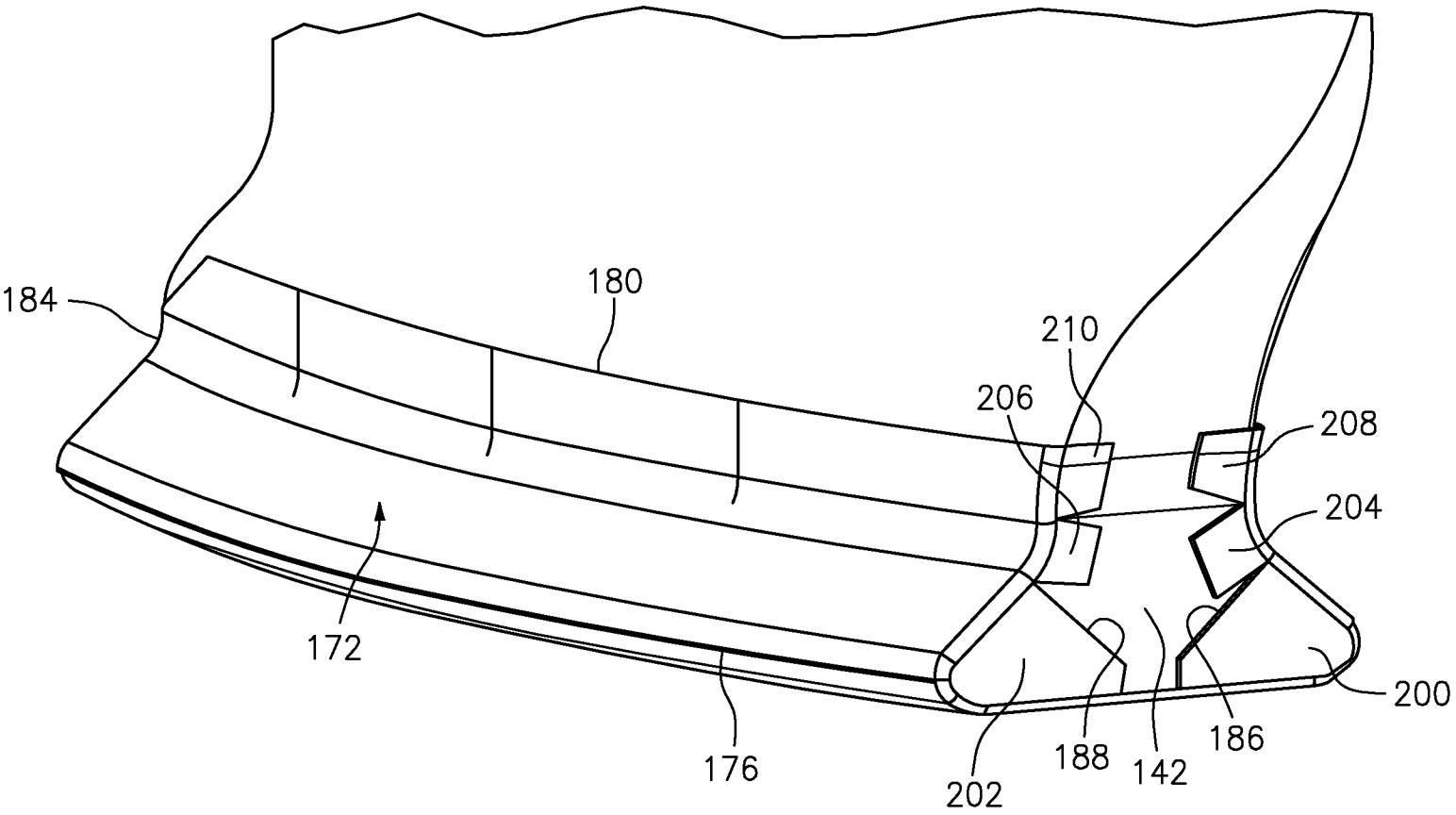
FIG. 3 is an isolated cutaway view of the blade of FIG. 2 viewed generally from the trailing edge and convex side

The root 124 has an inboard end or underside 134 and first and second lateral sides 136 and 138. These extend between a forward or leading face 140 and a rear or trailing face 142 (FIG. 3). When installed, the root fits within a slot 150 of a hub 152 extending inward from the hub outer diameter (OD) surface 154 between respective fore and aft faces of the hub.

The slot similarly to the root includes a base 160 and first and second sides 162 and 164. The roots and slots are dimensioned to be closely laterally accommodated with sufficient gap to contain wear pads 170 and 172. Each wear pad extends from an inboard edge 174, 176 to an outboard edge 178, 180 and from a leading end 182, 184 to a trailing end 186, 188. The wear pads are secured in place to the root by an adhesive (e.g., an epoxy such as a paste epoxy).

Each wear pad further includes an inboard face against the root and an outboard face away from the root. A portion of the outboard face contacts the adjacent slot side. End portions of the wear pads may wrap around one or both ends of the root. In the illustrated embodiment, end portions wrap around only the trailing end 142 (FIG. 3). By wrapping around, they pads intervene between the adjacent root end and a retaining ring (not shown) to reduce wear. As is discussed below, each end portion is divided into tabs 200, 202; 204, 206; and 208, 210.

Figure 5:
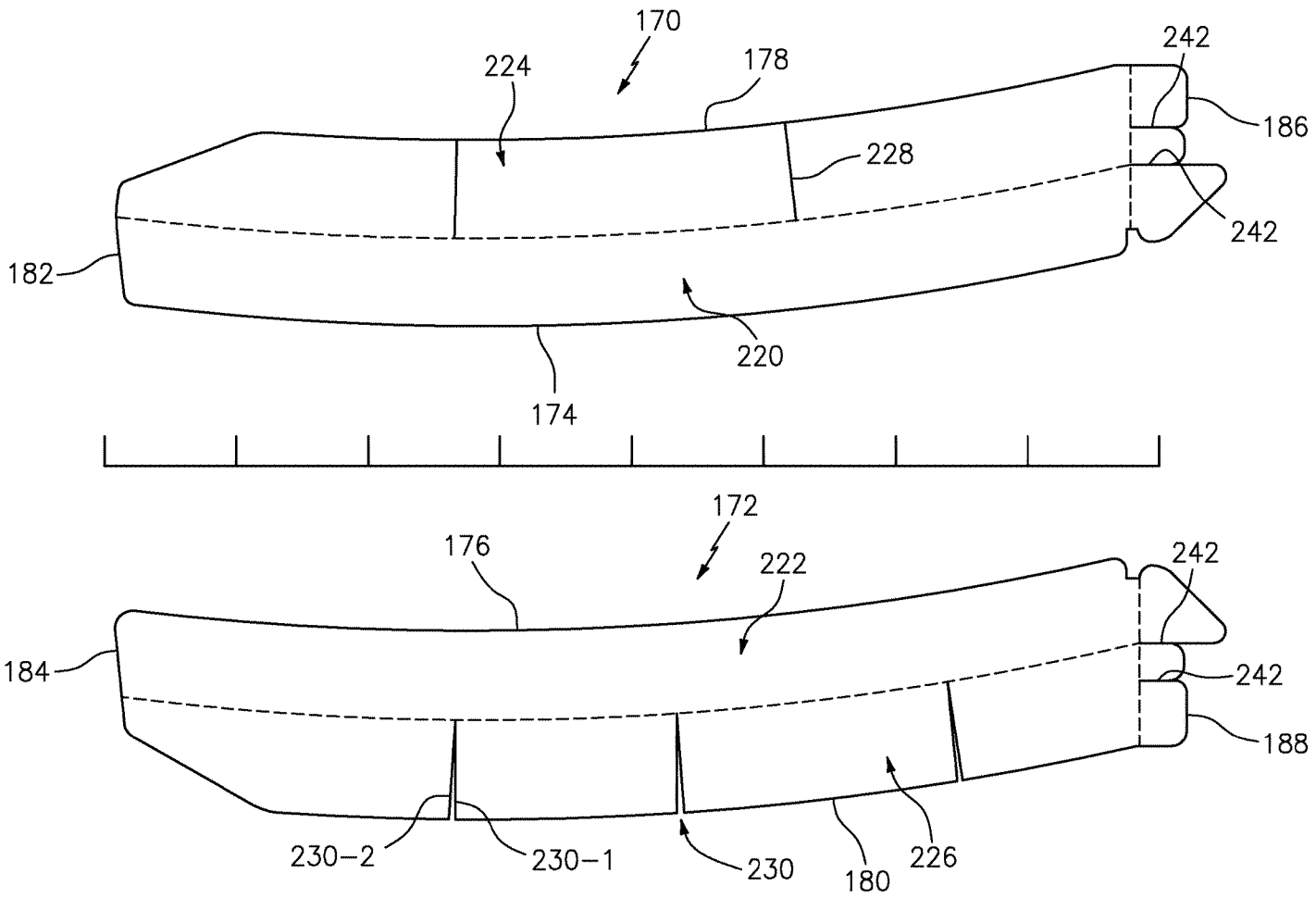
FIG. 5 is a plan view of a wear pad set (pair).

FIG. 5 shows the pads 170 and 172 as a pair of blanks as cut from larger sheet material. Solid lines indicate cuts and dashed lines indicate approximate bend/fold locations. The dashed lines may be merely notional or may be physically implemented via embossing or via by marking to facilitate alignment for installation. Viewed relative to their installed conditions, it is seen that the inboard edge 174 of the pad 170 is convex and the outboard edge 178 is concave; whereas the inboard edge of the pad 172 is concave and the outboard edge 180 of pad 172 is convex. Each pad has a generally contiguous and uninterrupted inboard portion 220, 222 and a segmented outboard portion 224, 226. The outboard portions are segmented by cuts 228, 230. The exemplary cuts 228 are simple single straight linear cuts. The exemplary cuts 230 are V-cuts where material is removed between a pair of linear cuts 230-1, 230-2 at a very slight angle to each other (e.g., less than) 5°.

The exemplary pad 170 outboard portion 224 is segmented into three sections; whereas the outboard section 226 of the pad 172 is segmented into four. When the pad 170 is installed, the cuts 228 form slots that open slightly. This opening helps maintain smoothness of the inboard portion 220. Similarly, the cuts 230 form slots that close slightly upon installation, also allowing for smoothness of the inboard portion 222.

Other implementations may alternatively or additionally segment slots along the pad inboard edge (which may fall along or near the root inboard end).

The fore-to-aft arcuate shape of the exemplary dovetail (associated with the corresponding general convexity of the blade suction side and concavity of the blade pressure side) combines with the inboard-to outboard curvature of the dovetail to create a doubly curved surface. The cuts help accommodate this curvature as an alternative to possible rumpling of a flat sheet without such cuts or the greater expense of molding the double curvature into a sheet-formed product. This allows use of simple flat sheetstock to be directly applied to the blade root.

The trailing edge tabs are also segmented from each other by associated cuts 242 (e.g., straight linear cuts) so that the cuts may form slots that open upon wrapping the tabs around the trailing edge.

In an exemplary sequence of manufacture, the blade is manufactured by conventional techniques (e.g., machining of aluminum or titanium or various composite formation techniques). The pads are cut from larger sheet stock material. Adhesive may be pre-applied to the stock material prior to cutting or may be post-applied. An exemplary cutting involves die cutting. An exemplary adhesive application is a post-cutting application comprising die cutting. The epoxy is then applied (e.g., by brush to an exemplary 0.004 inch (0.1 mm), more broadly 0.025 mm-0.2 mm)). The exemplary material thickness between faces is 0.012 inch (0.3 mm), more broadly 0.1 mm-0.6 mm, more narrowly, 0.2 mm-0.4 mm.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic blade configuration, details of such configuration or its associated engine may influence details of particular implementations. Accordingly, other embodiments are within the scope of the following claims.

What is claimed is:

1. A blade assembly comprising:

a blade (120) having:

an attachment root (124) having a forward axial end face (140) and an aft axial end face (142); and an airfoil(122) including a leading edge (126), a trailing edge (128), a pressure side (130), a suction side (132), a tip, and the airfoil extending from the attachment root to the tip; and one or more wear pads (170, 172) comprising a fabric and axially disposed along the attachment root, and at least one of the one or more wear pads having a peripheral edge and defining multiple cuts therethrough, the peripheral edge further defining at least a portion of each cut of the multiple cuts, and a plurality of cuts (242) of the multiple cuts being formed at one of the axial ends of the at least one of the one or more wear pads.

2. The blade assembly of claim 1 wherein:

the one or more wear pads comprise a first wear pad (170) on a first side of the attachment root and a second wear pad (172) along a second side of the attachment root opposite the first side.

3. The blade assembly of claim 2, wherein:

the one or more wear pads include a first wear pad and a second wear pad; and the first wear pad and the second wear pad each have a respective end portion along at least one of a leading end and a trailing end of the attachment root.

4. The blade assembly of claim 3 wherein, for each of the first wear pad and second wear pad, the multiple cuts include a plurality of cuts opening along said at least one of a leading end and a trailing end of the attachment root.

5. The blade assembly of claim 1 wherein:

the blade comprises an aluminum alloy or titanium alloy substrate.

6. The blade assembly of claim 1, wherein:

the wear pad comprises polyimide fiber.

7. The blade assembly of claim 1, wherein:

the one or more wear pads are adhered via adhesive to the attachment root.

8. The blade assembly of claim 7, wherein:

the one or more wear pads include a first wear pad and a second wear pad; and the first wear pad and the second wear pad each have a respective end portion along at least one of a leading end and a trailing end of the attachment root.

9. The blade assembly of claim 8 wherein, for each of the first wear pad and second wear pad, the cuts include a plurality of cuts opening along said at least one of a leading end and a trailing end of the attachment root.

10. The blade assembly of claim 1, wherein:

the multiple cuts include a plurality of radially outwardly directed cuts (228, 230) opening to an outboard edge portion of the peripheral edge of the associated wear pad of the one or more wear pads along an associated lateral side of the attachment root.

11. The blade assembly of claim 1, wherein:

the attachment root is a dovetail root.

12. A gas turbine engine comprising:

a fan hub (152) having a plurality of slots (150); and a plurality of blade assemblies of claim 1 with the attachment roots accommodated in associated said slots.

13. The blade assembly of claim 1, wherein:

the one or more wear pads include a first wear pad and a second wear pad; and the first wear pad and the second wear pad each have a respective end portion along at least one of said forward face or said rear face of the attachment root.

14. The blade assembly of claim 13 wherein, each of the first wear pad and second wear pad comprises a plurality of cuts opening along said at least one of said forward face and said rear face of the attachment root.

15. A method for manufacturing a blade assembly, the blade assembly comprising:

a blade (120) having an airfoil(122) having a leading edge (126), a trailing edge (128), a pressure side (130), and a suction side (132) and extending from an inboard end to a tip; and an attachment root (124); and one or more wear pads (170, 172) along the attachment root, wherein:

the attachment root has:

a forward face (140) and a rear face (142); and extending between the forward face (140) and the rear face (142), an underside (134), a first lateral side (136), and a second lateral side (138); and the one or more wear pads have a plurality of cuts (228, 230) having open ends at one or more edges of the one or more wear pads at one or more of the first lateral side and the second lateral side between the forward face and the rear face of the attachment root, the method comprising:

cutting the one or more wear pads from pad material, including cutting the plurality of cuts; and applying the one or more wear pads to the attachment root, said applying including at least one of:

expanding the width of the open end of at least one first cut of the plurality of cuts in relation to the width of said at least one first cut prior to the applying; and contracting the width of the open end of at least one second cut of the plurality of cuts in relation to the width of said at least one second cut prior to the applying.

16. The method of claim 15 wherein said applying contracts the at least one second cut along said second lateral side of the attachment root and expands the at least one first cut along said first lateral side.

17. The method of claim 15 wherein said applying comprises applying a wear pad of the one or more wear pads along both at least one of said first lateral side and said second lateral side of the attachment root and at least one of said first face and said second face of the attachment root.

18. A blade assembly comprising:

a blade (120) having an airfoil(122) having a leading edge (126), a trailing edge (128), a pressure side (130), and a suction side (132) and extending from an inboard end to a tip; and an attachment root (124); and one or more wear pads (170, 172) comprising a fabric along the attachment root, wherein:

the attachment root has:

a forward face (140) and a rear face (142); and extending between the forward face (140) and the rear face (142), an underside (134), a first lateral side (136), and a second lateral side (138); and the one or more wear pads have a plurality of cuts (228, 230) having open ends at one or more edges of the one or more wear pads at one or more of the first lateral side and the second lateral side.

19. The blade assembly of claim 18, wherein:

the one or more wear pads further have a plurality of cuts (242) opening along an end portion of the pad along at least one of the forward face and the rear face of the attachment root.

20. The blade assembly of claim 18, wherein:

the one or more wear pads include a first wear pad along the first lateral side and a second wear pad along the second lateral side; and the first wear pad and the second wear pad each have a respective end portion along at least one of the forward face and the rear face.

* * * * *